United States Patent [19]

Fondriest

[11] 4,198,097

[45] Apr. 15, 1980

[54] METHOD OF MINING

[75] Inventor: F. Frederick Fondriest, Lake Forest, Ill.

[73] Assignee: Standard Oil Company, Chicago, Ill.

[21] Appl. No.: 803,730

[22] Filed: Jun. 6, 1977

[51] Int. Cl.[2] ..... E21C 41/10

[52] U.S. Cl. ..... 299/11; 299/19

[58] Field of Search ..... 299/11, 18, 19, 2

[56] References Cited

U.S. PATENT DOCUMENTS

| | | | |
|---|---|---|---|
| 3,459,003 | 8/1969 | O'Neal | 299/11 |
| 3,525,551 | 8/1970 | Mallander | 299/11 |
| 3,527,500 | 9/1970 | Thompson | 299/11 |

FOREIGN PATENT DOCUMENTS

| | | | |
|---|---|---|---|
| 125787 | 5/1958 | U.S.S.R. | 299/11 |

OTHER PUBLICATIONS

Mining Engineering Hndbk., Robert Peele, 3 ed. John Wiley & Sons pp. 492–495.

*Primary Examiner*—William F. Pate, III

*Attorney, Agent, or Firm*—Thomas J. Connelly; William T. McClain; William H. Magidson

[57] ABSTRACT

A method of mining a seam of rigid hydrocarbonaceous containing mineral such as oil shale or coal whereby essentially complete recovery of the mineral deposit is possible. This method comprises the steps of apportioning the seam into one or more working horizons and extracting from about 15 to about 85 percent of the mineral in a horizon using a room and pillar mining technique. The void areas resulting from the above mining operation are then filled with concrete, which is formed from cement made from spent residue and aggregate comprised of additional spent material. After the void areas are filled the remaining mineral is removed and additional concrete is deposited. Subsequently, an adjacent horizon, either above or below the initial horizon, is excavated by repeating the above steps until essentially all of the mineral deposit is recovered.

13 Claims, 4 Drawing Figures

METHOD OF MINING

BACKGROUND OF THE INVENTION

1. Field of the Invention

The present invention relates to a method of mining a seam of rigid hydrocarbonaceous containing mineral such as oil shale or coal, utilizing a room and pillar mining technique whereby essentially complete recovery of the mineral deposit is possible. This method comprises the steps of extracting a portion of the mineral using a room and pillar mining technique and then filling the void areas which result with a structural grade concrete made up of the waste products from the mineral after the hydrocarbonaceous values have ben withdrawn. When the concrete hardens, it provides support for the overburden and allows the remaining mineral to be removed. Further, this invention discloses an effective way to dispose of the waste by-product after the hydrocarbonaceous values have been withdrawn and alleviates the need for surface disposal. Furthermore, this invention reduces or eliminates surface subsidence.

2. Description of the Prior Art

The most widely used method for mining underground deposits of minerals throughout the world is the room and pillar technique. This method has been utilized to a large extent in mineral mining for it has proven to be the most economical way to obtain the maximum extraction from the deposit while allowing compliance with the safety standards of the industry. By this method, the valuable minerals are mined in rooms separated by narrow ribs or pillars. This is accomplished by forming a series of tunnels or entries into the mineral seam and then extracting additional mineral material by working a series of rooms or tunnels off of the first entry way. There are many modifications of the basic method, such as: County of Durham system, double entry room and pillar mining system, double room system, double stall system, pillar and stall, room and stoop, single entry system, single stall system, etc. Generally speaking, there are two basic pillar systems--randomly spaced pillars and regularly spaced pillars or ribs. The selection of either system is based on the type of deposit that is to be mined and the depth of the overburden. For example, the irregularly spaced pillars are usually formed in deposits in which the areal mineralization is variable. In such a case, the rich areas are mined and the pillars are formed in the lean areas. The regularly spaced pillars, which are usually square or rectangular in shape, are used in deposits in which the mineralization is more uniform, such as in coal or other nonmetallic mineral mines. Perhaps the most commonly seen form of room and pillar mining is the rib pillar design system. In this particular design, the rib pillars are usually rectangular in shape and formed by the excavation of parallel openings in which the dimension parallel to the openings is much greater than the distance between the openings. The room and pillar technique has received great acclaim for it uses the sidewalls and unexcavated pillars to carry the high stress loads imposed by the overlying mineral and surface rock. Even though one uses a room and pillar mining technique, one must still leave a considerable portion of the mineral in place in the form of walls and pillars in order to support the overburden. It is known, for example, that in coal mining the recovery rate is seldom over 85%, and on the average the recovery rate for United States coal mines is only 50%. This factor is attributed to the stress factors present in every mine and the load distribution on each pillar. SME Mining Engineering Handbook, Volume 1, chapter 7, incorporated by reference and made a part hereof, describes the design and stability of excavations in subsurface formations. A volume-extraction ratio is disclosed on pages 7–41 and 7–42 and is defined as the ratio of the mined (or minerable) material to the total volume of the mineral deposit. This ratio will vary according to the compressive-stress concentration in the pillars and the particular mining arrangement employed.

It is obvious that the amount of recoverable mineral is dependent upon: (1) the stress load and (2) the arrangement and size of the pillars. Generally, rib pillars provide a very stable system for openings but for mineral mining they may not produce the best system for recovering the greatest amount of material. For example, to obtain a good extraction ratio, say 75 percent, the room width has to be three times the pillar width. For an effective pillar width that will produce a stable pillar, the room width may be so large that the roof is unstable. Usually, a better extraction ratio can be obtained with a three-dimensional system of random pillars, or with grids of regularly spaced square or rectangular pillars.

Another method that is used to increase the recovery rate in room and pillar mining is the operation in which a substantial portion of the pillars are removed upon retreating from the mine. This does, however, result in the partial or total subsidence of the land surface. Depending upon the location, it is sometimes impractical or impossible to permit subsidence for the miner may not own the surface rights or because disruption of surface drainage or tansportation systems may result.

In the case of oil shale, the mineral recovery rate may vary from as little as 15 percent to as high as 70 percent, depending upon the thickness of the oil shale seam and the depth of overburden. The following table gives an indication of typical recovery rates for room and pillar mining of oil shale as it relates to the depth of the mineral seam.

Table I

| Depth of Cover - ft. | % Left in Pillars |
|---|---|
| 200 | 50 |
| 200–500 | 50–60 |
| 500–1000 | 60–70 |
| 1000–2000 | 70–85 |

"Oil Shales and Shale Oils", by H. S. Bell; D. Van Nostrand Co., Inc., New York; 1948.

For very thick seams of oil shale such as those of the Piceance basis of Colorado, which vary in thickness up to 1000 feet, the recovery rate by room and pillar mining may be even lower than those indicated in the above table. This low output is caused by the composition of the oil shale and the typical way a seam is worked. In oil shale, a horizontal working entry or horizon is usually no greater than 60 feet high. Since it is important to maintain the integrity of the roof and floor of the horizon, it is necessary to leave undisturbed a seam of 40 to 60 feet of virgin material between parallel working horizons. Accordingly, in the vertical plane, only alternate horizons of approximately 60 feet each, of a thick oil shale seam are mined. There arises also the necessity of columnizing the working horizons in order to adequately support the overburden.

Where practical, artificial pillars may be constructed to prevent or delay roof collapse prior to partial or total pillar removal. Artificial pillars can be constructed of wood posts, wood or concrete cribbing (which may or may not be filled with rubble or as taught in U.S. Pat. No. 1,004,419), or constructing a supporting crib of in situ rock blasted from the floor and ceiling of a mined-out coal vein and filling the voids with flushed mining waste. However, the strength and integrity of these artificial pillars is often unknown, making the removal of the mineral pillars hazardous. Also for very deep mineral seams the cost of constructing a sufficient number of artificial pillars for total roof support may well exceed the value of additional minerals recovered.

Further, it is known that the waste residue from hydrocarbonaceous containing minerals may be used in the production of a Portland type cement. Typical analyses of the residue from pyrolized coal and oil shale are shown in Table 2.

Table 2

| Mineral Matter | Weight Percent Coal Ash | Weight Percent Spent Shale |
|---|---|---|
| $SiO_2$ | 35–50 | 30–35 |
| $Al_2O_3$ | 20–35 | 5–15 |
| CaO | 5–25 | 15–20 |
| $Fe_2O_3$ | 3–15 | 2–5 |
| MgO | 1–3 | 3–10 |
| $K_2O$ | 0.5–2 | 1–3 |
| $SO_3$ | 2–7 | 1–3 |

These analyses show primarily cement forming oxides that, when combined with a lime containing material and fired to a temperature of about 2800° F., form a hydraulic cement. U.S. Pat. No. 3,759,730 describes a process for producing a Portland type cement from coal ash. The procedures for producing a hydraulic cement from spent shale are adequately described in U.S. Pat. No. 3,459,003. This latter patent further describes a method of pumping a slurry of cement made from spent shale into a body of spent shale particles previously deposited in slurry form into a mined-out area. The purpose of this procedure is to increase the density and therefore the amount of spent shale which may be disposed of in the mined-out area.

In mining the deposits of oil shale which exist in the United States, one can typically expect to recover approximately 10 to 50 gallons of oil per ton of oil shale. The extraction of the shale oil by pyrolysis produces a spent shale residue which is greater in volume than the original oil shale as mined. The spent residue therefore presents a serious disposal problem. It has been proposed that a substantial portion of this spent shale residue may be deposited in the mined-out area, thereby limiting the amount of residue which must be disposed of on the ground surface. Developed methods of depositing and compacting spent shale residues on the ground surface may, if not properly controlled, present serious environmental problems.

As to coal ash, the disposal of this waste residue presents a lesser problem for the typical coals available in the United States contain no greater than 15 percent ash. Although a similar disposal problem is present, the quantity of material to be disposed of greatly reduces the nature of the problem. It should also be noted that coal ash is produced at the location where the coal is burned not mined, and therfore the spent residue is not on site as it would be in the case of oil shale.

SUMMARY OF THE INVENTION

In accordance with this invention, it has been found that a seam of rigid hydrocarbonaceous containing mineral such as oil shale or coal, can be mined in such a manner so that essentially complete recovery of the mineral deposit is possible. This method comprises the steps of apportioning the seam into one or more working horizons and extracting from about 15 to about 85 percent of the mineral in a horizon using a room and pillar mining technique. The void areas resulting from the above mining operation are then filled with concrete thereby allowing the remaining mineral in the horizon to be excavated. Additional concrete is then deposited in the void areas resulting from the second extraction operation. Subsequently, an adjacent horizon either above or below the initial horizon is then mined by repeating the above steps until essentially all of the mineral deposit is recovered.

The advantage of this method of mining is that it enables substantially all of the hydrocarbonaceous containing mineral to be excavated safely and without the fear of incurring any considerable amount of subsidence. It also provides a feasible means for the disposal of spent material and can prevent the migration of ground water from flowing through the mined out area and absorbing undesirable amounts of salts.

DESCRIPTION OF THE PREFERRED EMBODIMENTS

Figure 1:
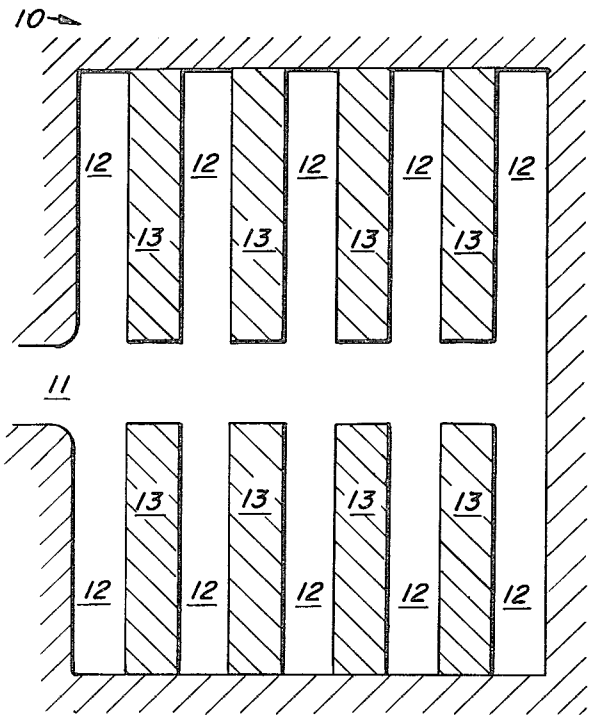
FIG. 1 is a plan view of mining panel featuring a room and pillar mining technique.

Referring now to the drawings, and more specifically to FIG. 1, this invention shows the development of a mining panel incorporating a slight variation of the well known room and pillar mining technique. An entry drift 11 is first excavated to the full length of the working panel which can vary in dimensions depending on conditions. Transverse rooms or tunnels 12 are then excavated normal to entry drift 11 and all of the mined material removed. This process results in having several mining pillars 13 supporting the overburden and mining a number of tunnels or void spaces 12 in between the pillars 13. In order to remove the rich mineral deposits constituting the pillars, it is necessary that another form of support be provided. In our invention, a structural grade concrete made by a process to be subsequently described herein is placed into the rooms or tunnels 12 and allowed to harden. The initial pillars 13 are now excavated and the minerals removed. The voids left after mining pillars 13 are removed can be filled with additional structural grade concrete to provide total roof or floor support. Upon retreating from mining panel 10, the entry drift 11 can also be filled with concrete. The concrete may be deposited in place by: air deposition as in the gunite process; gravity feed; a mechanical slinger; a concrete sprayer such as the Aliva sprayer; or by any other feasible means. The concrete can be transported from the surface or other location by means of a conveyor, hoist, bucket, pipe or any other mechanical transporting means. It may appear to be more economical to form a slurry made up of spent shale, cement and water and to pump this mixture through a flexible pipe or hose to the desired location. The apparatus for positioning the concrete can be attached to the opposite end of the pipe or hose for easy placement. The concrete can be placed or poured in numerous ways but it would appear to be feasible, especially when forming a large high pillar, to construct such a structure in layers perhaps four to five feet thick. Utilizing this procedure, one could form a pillar 50 or more feet in height without the need of shoring up forms. Granted, the exposed end of the room or tunnel nearest the entry drift 11 will have a slight declining slope to it but this angle of repose will be small compared to the total length of the concrete pillar and will not affect the amount of support the pillar will provide. It is also desirable to use a concrete that contains a minimum amount of water so as to facilitate its stability once placed. This semidry state of the concrete will shorten the curing process and reduce the amount of heat given off as the concrete sets, as well as providing increased strength.

Figure 2:
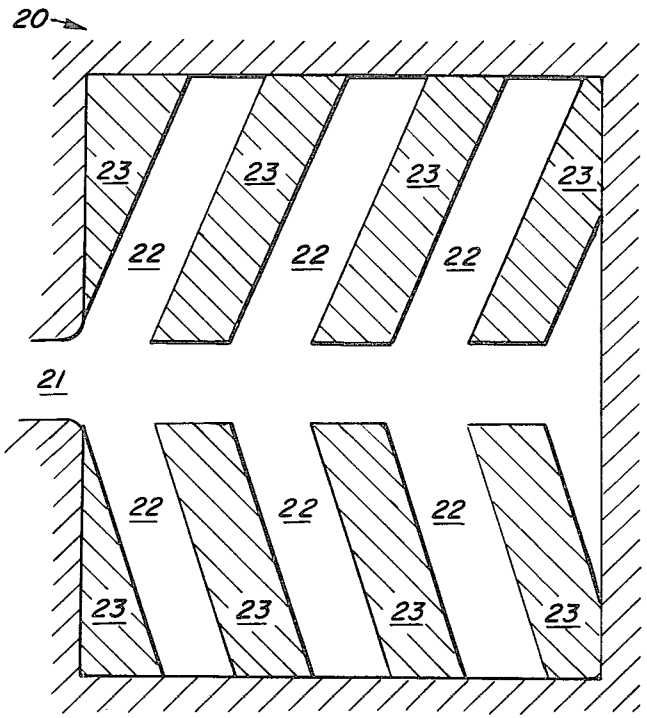
FIG. 2 is a plan view of a mining panel featuring a room and pillar mining technique showing an alternative arrangement of the excavating scheme.

Referring now to FIG. 2, mining panel 20 depicts a sequential process similar to that described above with one exception, that being the rooms or tunnels 22 extend away from entry drift 21 at an angle. The purpose for this alternative design relates more specifically to the mining operation of oil shale. Generally, seams of oil shale exist with thickness up to as much as 1000 feet whereas a typical working area for room and pillar mining will be only 60 feet thick. Due to the fundamental necessity of maintaining the integrity of the roof or floor of the working area, it is essential that an undisturbed zone of virgin material roughly 40 to 60 feet thick, be left between each and every excavated room or tunnel. The composition of the overburden may also necessitate columnizing the working area in order to provide the required support. By virtue of this improved mining technique the mined-out area is completely replaced and supported by a structural grade concrete. Accordingly, it is unnecessary to leave an unmined portion between successive excavated rooms or tunnels. In other words, after completing the total operation in any working horizon, the next successive horizon may be excavated immediately above or below the previously completed area. In the event that the second working horizon is immediately below the first, the roof of the second working horizon would, by virtue of this invention, be comprised of solid concrete. In order to ensure the integrity of the concrete roof, the angle of the room entries 22 may be reversed in each successive working horizon, such that the concrete roof will be supported by virtue of the bending strength of the concrete as opposed to a sheer support if the sequence as described in FIG. 1 is used. It is also possible to stagger the tunnels to obtain an overlapping arrangement which will thereby increase the sheer support. An additional advantage of the method described herein is to eliminate the need for roof bolting, since a concrete roof would not present the problem of spalling or falling rock.

In the case of coal mining, the mineral seams or veins are usually quite thin and seldom exceed 10 feet in thickness. For this reason, it is feasible to work the entire vein in a single pass as opposed to excavating multiple rooms or tunnels associated with an oil shale mine. In addition, there is a substantial reduction of ash content from coal and this will limit the amount of cement which may be made therefrom. Accordingly, it is not necessary to attempt to completely fill the mined-out area with concrete. Instead it is sufficient if only the void area equal to the area of the pillars to be removed be filled, for this will provide adequate support for the overburden. The remaining void spaces can then be used to accommodate any additional rubblized residue.

Figure 3:
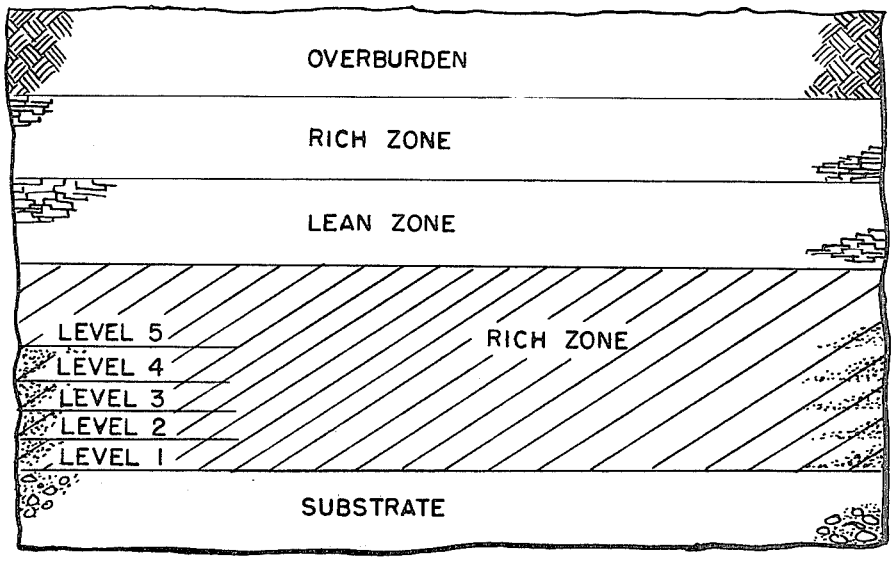
FIG. 3 is a plan view of a mineral deposit featuring rich and lean areas of oil shale as well as showing several working levels.

Referring now to FIG. 3, a typical oil shale deposit will exhibit zones of both rich and lean mineral and it may be economically desirable to use the process disclosed herein on only the rich zones. This is possible for Applicant's improved method of mining allows one to start excavation at any depth of the pay zone and to mine any part of the entire mineral deposit. It is also possible for one to return at a later date to mine the remaining mineral when it becomes economically justifiable. In addition, FIG. 3 shows that a total pay zone of hydrocarbonaceous containing mineral may be apportioned into numerous levels or horizons which can be mined individually. By this procedure, it is possible to recover all of the mineral on one level before proceeding to the next adjacent level. If it appears desirable to skip a level, for whatever reason, this may be done. In a typical deposit, it will be desirable to mine each and every level but in the past this has been impractical because some levels had to be left in place in order to provide the necessary support for overlying material. Using Applicant's process, it is possible for example, to excavate level 1, fill with concrete, proceed to level 2, etc. In this way essentially all of the mineral deposit can be recovered.

Figure 4:
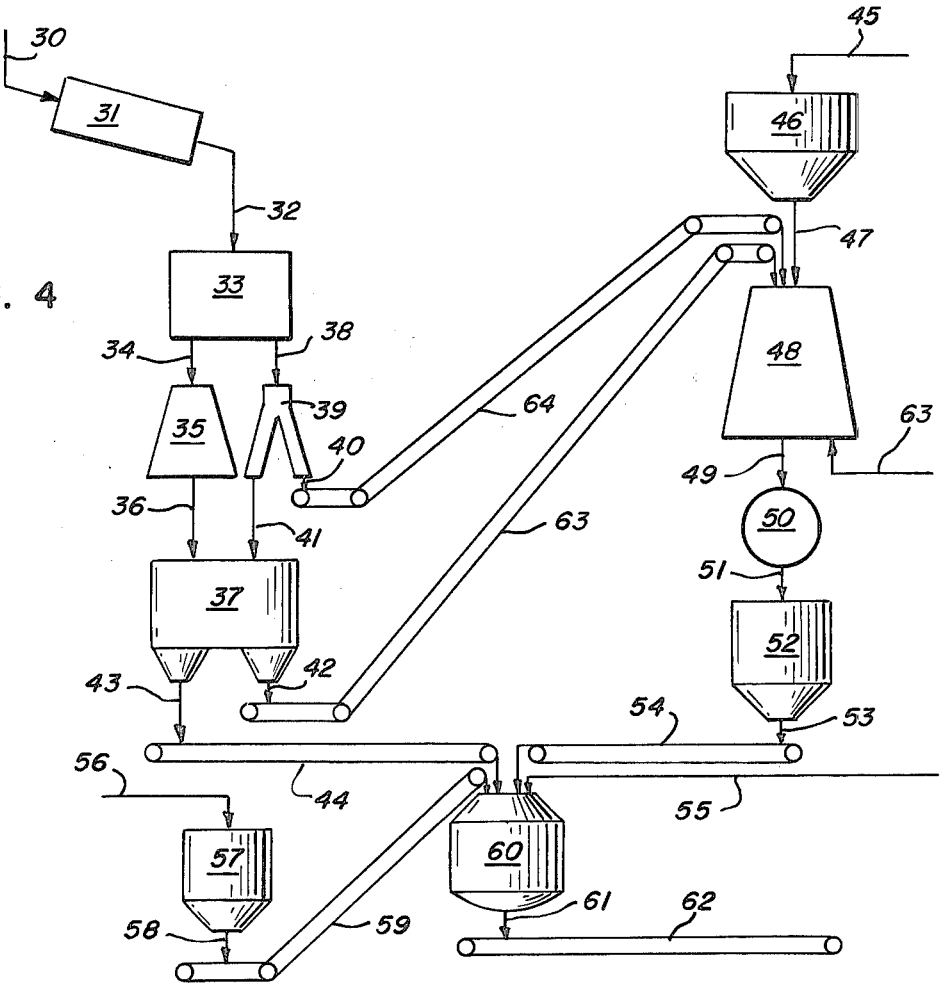
FIG. 4 shows a process flow diagram for a method of converting spent shale residue to a hydraulic cement for subsequent disposal in a mined-out area.

Referring now to FIG. 4, oil shale is fed via line 30 into shale retort 31 for pyrolysis to remove the hydrocarbon values. The spent shale residue is sent via line 32 to size separator 33 for removing the smaller residue particles. Depending upon the type of shale retort used, the spent shale residue may range in size from very fine grained materials to particles as large as 4 inches. For the purposes of providing a feed to a cement kiln, the spent shale residue must have a size fraction less than 1/16 inch. Accordingly, fine grained spent shale from size separator 33 may be transferred via line 38 through splitter 39. Splitter 39 separates the fined grained material and directs an appropriate amount via line 40 to be conveyed via conveyor 64 for direct feed into cement kiln 48. Surplus material leaving splitter 39 is transferred via line 41 to storage bin 37 for subsequent use. The large particles of the spent shale are removed from size separator 33 and piped via line 34 to crusher 35. The reduced particle sizes are then piped via line 36 to storage bin 37. If sufficient fines are not available in the spent shale as it exits the shale retort 31, additional crushed material may be transferred from storage bin 37 via line 42 to be conveyed via conveyor 63 as further feed to cement kiln 48. A source of limestone or lime containing material may be supplied via line 45 into storage bin 46 and subsequently fed as needed via line 47 into cement kiln 48. The relative amount of spent shale feed as opposed to limestone will depend upon the composition of the spent shale and whether the limestone feed is totally or partially calcined. Additionally, the spent shale extracted from shale retort 31 will contain as much as 6% unburned carbon. The unburned carbon on the spent shale will in most cases provide sufficient heat energy in cement kiln 48 such that an auxiliary heat source is not required. This is particularly true in those cases where the spent shale exits shale retort 31 at temperatures typicaly between 300° and 900° F. Where necessary or desirable, waste heat from the pyrolysis process may be used to preheat the limestone feed or, in the alternative, precalcined lime may be used where readily available. After the feed materials have been fired in cement kiln 48, the cement clinkers are routed via line 49 into grinder 50 to reduce the clinkers to a suitable surface size. The ground cement is then transferred via line 51 to storage bin 52 for use as needed. For the purposes of providing the concrete backfill material, cement is fed via line 53 on to conveyor 54 where it is fed into cement mixer 60. Aggregate for the cement is supplied by crushed spent shale from storage bin 37 via line 43 to conveyor 44. The necessary water is piped from a source via line 55 directly into concrete mixer 60. Where, by the nature of the oil shale mining operation, it is necessary to extract a lean shale which may not be economically pyrolysized, this lean shale material may be crushed and fed via line 56 to storage bin 57 for subsequent use as a lare aggregate in the concrete mixer. The lean shale aggregate is fed via line 58 to conveyor 59 and thereafter conveyed into concrete mixer 60. The resultant structural grade concrete is withdrawn from mixer 60 and fed via line 61 to conveyor 62 for subsequent transport to the mine.

By the means described herein, essentially all of the spent shale residue may be used in such a way as to effectively preclude the need for surface disposition. Typically, about 15 percent of the spent shale residue would be required as a feed for cement production. Essentially all of the balance of the spent shale may be used as a fine grained aggregate. Depending upon the amount of calcining, if any, which occurs in the pyrolysis process, there may remain an excess volume of spent shale which cannot be disposed of in the mined-out area. In this event it may be desirable to calcine a portion of the spent shale residue in order to reduce its volume. This may be accomplished in a kiln similar to a cement kiln with no further heat input requirements other than the value of the carbon remaining on the spent shale. Where practical, by virtue of a ready market for the cement produced, it is possible to convert the entire amount of spent to a structural grade Portland cement which may be used for any construction purpose.

It is recognized that the above description describes in general the nature and objectives of the present invention. It will be obvious to one skilled in the art that a number of variations may be incorporated without changing or altering the nature and scope of this invention.

I claim:

1. A method of mining a seam of rigid hydrocarbonaceous containing mineral such as oil shale or coal, whereby the seam is apportioned into working horizons and each selected horizon is mined separately for essentially complete recovery of the mineral deposit, which comprises the steps of:

(a) extracting from about 15 to about 85 percent of the mineral in a first selected horizon using a room and pillar mining technique;

(b) filling the void areas resulting from the operation of step (a) with concrete;

(c) extracting the remaining mineral pillars for essentially complete recovery in the first selected horizon of the hydrocarbonaceous values;

(d) filling the void areas resulting from the operation of step (c) with concrete; and (e) repeating the above steps on each subsequently selected horizon for essentially complete recovery of the entire mineral deposit.

2. A mining method as recited in claim 1 wherein the room and pillar mining technique is varied so that the rooms are tunnels located perpendicular to a main entry drift.

3. A mining method as recited in claim 1 wherein the room and pillar mining technique is varied so that the rooms are tunnels which angle off a main entry drift.

4. A mining method as recited in claim 1 wherein the concrete used to fill the void areas contains spent residue of the hydrocarbonaceous mineral.

5. A mining method as recited in claim 1 wherein the concrete used to fill the void areas contains cement made from spent residue of the hydrocarbonaceous mineral.

6. A method of mining a seam of rigid hydrocarbonaceous containing material such as oil shale or coal, whereby the seam is apportioned into working horizons and each selected horizon is mined separately for essentially complete recovery of the mineral deposit, which comprises the steps of:

(a) employing a room and pillar mining technique to extract about 15 to about 85 percent of the mineral situated in a first selected horizon;

(b) retorting the extracted mineral to recover the hydrocarbonaceous values and leaving a spent residue;

(c) mixing a portion of the spent residue with about 20 to about 80 percent by weight of a lime containing material;

(d) calcining the mixture of step (c) to produce a hydraulic cementitious material;

(e) combining about 5 to about 20 percent by volume of the hydraulic cementitious material with additional spent residue to for a structural grade concrete;

(f) depositing the structural grade concrete in the void areas resulting from the mining operation of step (a);

(g) extracting the remaining mineral pillars in the first selected horizon for essentially complete recovery of the hydrocarbonaceous values;

(h) filling the void areas resulting from the operation of step (g) with concrete; and (i) repeating the above steps on each subsequently selected horizon until essentially all of the mineral deposit of the underground seam is recovered.

7. A mining method as recited in claim 6 wherein the room and pillar mining technique is varied so that the rooms are tunnels located perpendicular to a main entry drift.

8. A mining method as recited in claim 6 wherein the room and pillar mining technique is varied so that the rooms are tunnels which angle off a main entry drift.

9. A mining method as recited in claim 6 wherein one or more horizons are left unmined.

10. A mining method as recited in claim 1 wherein said rigid hydrocarbonaceous containing mineral is oil shale.

11. A mining method as recited in claim 6 wherein said rigid hydrocarbonaceous containing mineral is oil shale.

12. A mining method as recited in claim 1 wherein said rigid hydrocarbonaceous containing mineral is coal.

13. A mining method as recited in claim 6 wherein said rigid hydrocarbonaceous containing mineral is coal.

* * * * *

UNITED STATES PATENT OFFICE

CERTIFICATE OF CORRECTION

Patent No. 4,198,097 Dated April 15, 1980

Inventor(s) F. Frederick Fondriest

It is certified that error appears in the above-identified patent and that said Letters Patent are hereby corrected as shown below:

| Patent Column | Line | |
|---|---|---|
| 7 | 22 | "lare" should be --large-- |
| 7 | 44 | "spent to" should be --spent shale to" |
| 8 | 18 | "material" should be --mineral-- |
| 8 | 35 | "for" should be --form-- |

Signed and Sealed this

*Twenty-second* Day of *July 1980*

[SEAL]

*Attest:*

SIDNEY A. DIAMOND

*Attesting Officer*

*Commissioner of Patents and Trademarks*